US006367377B1

(12) United States Patent
Gawley et al.

(10) Patent No.: US 6,367,377 B1
(45) Date of Patent: Apr. 9, 2002

(54) LEVEL SENSITIVE WASTE COMPACTOR

(75) Inventors: James Ernest Gawley, Bowmanville; Charlotte Mary-Anne May; Glenn Emile Rochon, both of Keswick, all of (CA)

(73) Assignee: Compact Waste Systems, Inc., Newmarket (CA)

( * ) Notice: Subject to any disclaimer, the term of this patent is extended or adjusted under 35 U.S.C. 154(b) by 0 days.

(21) Appl. No.: 09/231,032

(22) Filed: Jan. 14, 1999

(30) Foreign Application Priority Data

Oct. 16, 1998 (CA) ..... 2250547

(51) Int. Cl.[7] ..... B30B 15/14; B30B 1/10

(52) U.S. Cl. ..... 100/49; 100/52; 100/99; 100/229 A; 100/287; 100/345

(58) Field of Search ..... 100/45, 49, 50, 100/52, 99, 229 A, 343, 345, 286, 287, 215, 288

(56) References Cited

U.S. PATENT DOCUMENTS

| | | | | |
|---|---|---|---|---|
| 2,962,959 A | | 12/1960 | Sholin | |
| 3,212,432 A | | 10/1965 | Raab | |
| 3,212,433 A | | 10/1965 | Raab | |
| 3,772,984 A | * | 11/1973 | Karls et al. | 100/52 |
| 3,842,729 A | | 10/1974 | Mandrup | |
| 3,863,561 A | | 2/1975 | Karls | |
| 3,882,770 A | * | 5/1975 | Bleasdale | 100/49 |
| 3,918,359 A | | 11/1975 | Hennells | |
| 4,100,850 A | | 7/1978 | Wolbrink et al. | |
| 4,548,132 A | | 10/1985 | Moon | |
| 4,552,061 A | * | 11/1985 | Brutsman | 100/343 |
| 4,735,136 A | * | 4/1988 | Lee et al. | 100/52 |
| 4,781,111 A | * | 11/1988 | Chesnut | 100/229 A |
| RE33,527 E | | 1/1991 | Fox | |
| 5,012,732 A | | 5/1991 | Fox | |
| 5,025,719 A | | 6/1991 | Thomas | |
| 5,088,396 A | | 2/1992 | Thomas | |
| 5,259,304 A | * | 11/1993 | Roberts | 100/99 |
| 5,517,907 A | | 5/1996 | Fox | |
| 5,558,013 A | | 9/1996 | Blackstone, Jr. | |

FOREIGN PATENT DOCUMENTS

| | | |
|---|---|---|
| DE | 22 02 156 | 5/1979 |
| DE | 29 30 158 | 2/1981 |
| DE | 40 13 107 | 10/1991 |
| DE | 296 02 267 | 4/1996 |
| EP | 0 000 399 | 1/1979 |
| EP | 0 816 259 | 1/1998 |
| FR | 2 673 144 | 8/1992 |
| GB | 1248597 | 10/1971 |
| IT | 467282 | 12/1951 |

* cited by examiner

*Primary Examiner*—Stephen F. Gerrity
(74) *Attorney, Agent, or Firm*—Lerner, David, Littenberg, Krumholz & Mentlik

(57) ABSTRACT

A refuse compactor has a housing for containing a garbage receptacle, and a compression unit for compacting the refuse in the compaction unit from time to time. The compactor has a sensor for sensing the approach of persons wishing to deposit garbage. This sensor causes the opening of an inlet door. It has a second sensor, for gauging the level of refuse in the receptacle. When a sufficient bulk is collected, then the compression unit operates to compact the refuse. The compression unit is subject to three limiting conditions, the first being a "receptacle full" limit, the second being a load limit, and the third being a stroke limit. The compaction unit used is a scissors mechanism having one side of the scissors mechanism held in one plane.

8 Claims, 12 Drawing Sheets

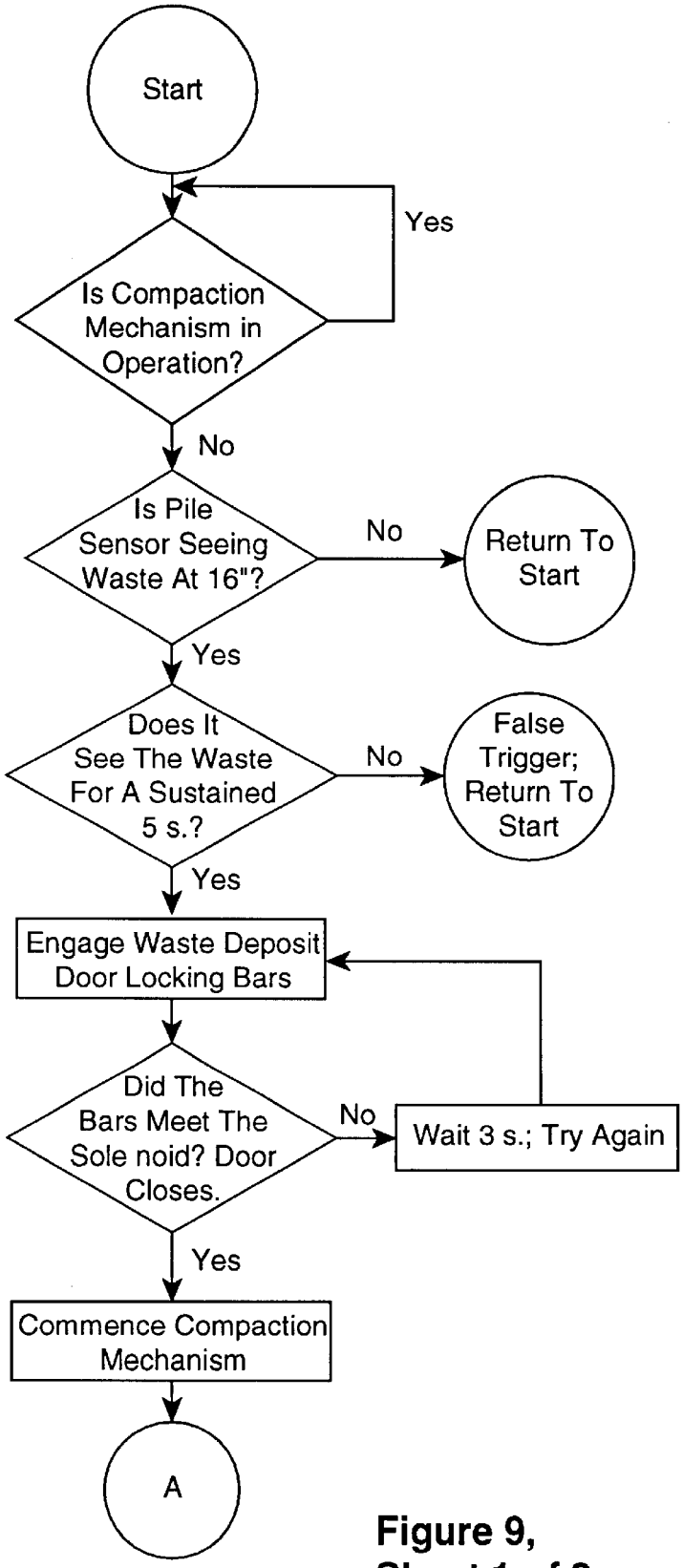
Figure 9, Sheet 1 of 2

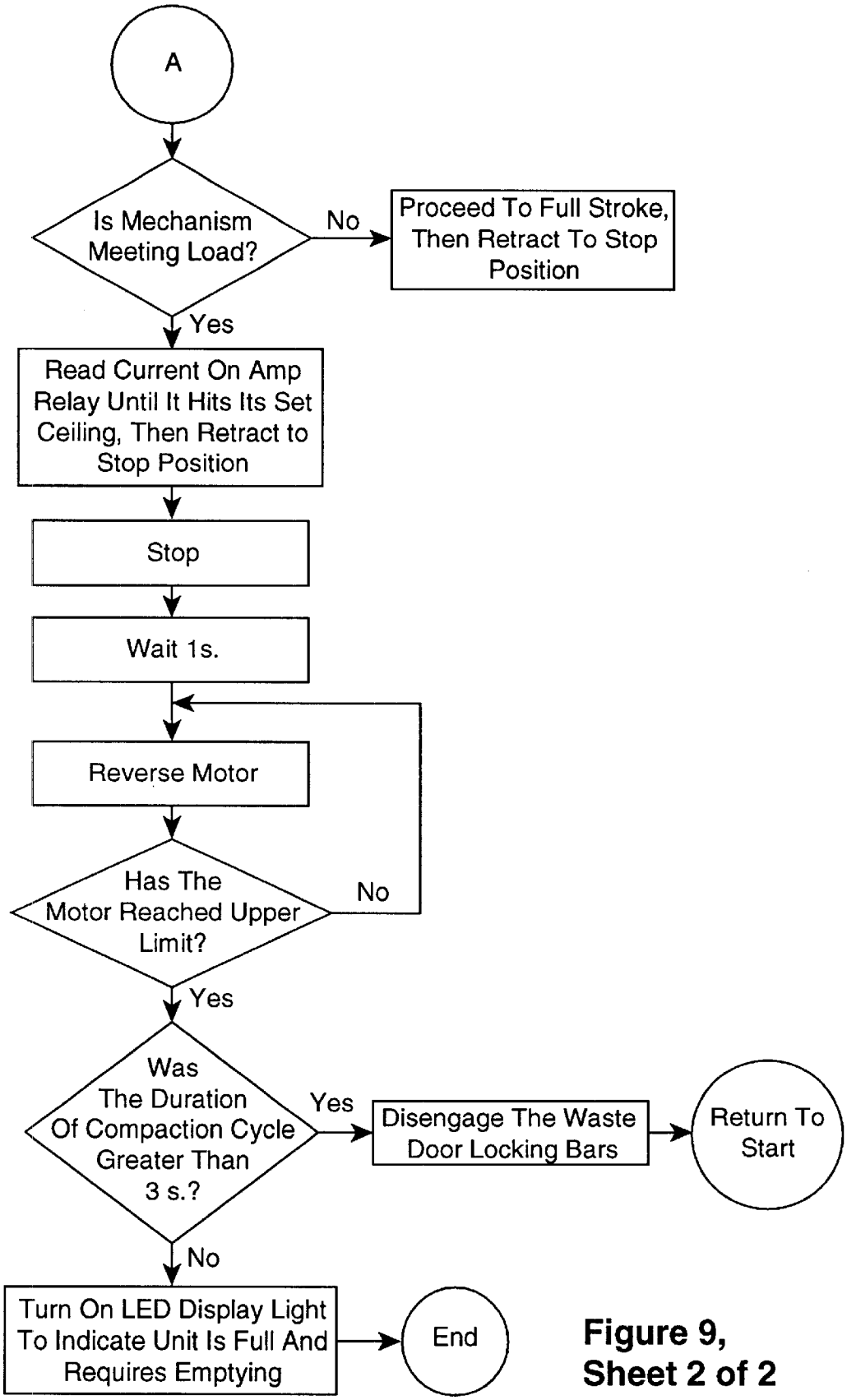
Figure 9, Sheet 2 of 2

LEVEL SENSITIVE WASTE COMPACTOR

FIELD OF INVENTION

This invention relates generally to waste compactors, and, in particular, to waste compactors for receiving inputs of waste and periodically compacting those inputs.

BACKGROUND ART

While waste compactors have been known for domestic use, such machines can also be useful in fast food restaurants and shopping malls for compaction of loose garbage. In general, refuse from fast food restaurants such as may be deposited in waste containers has a relatively low density. It is desirable to compact this garbage for several reasons. First, very low density garbage such as paper cups, hamburger containers, tissue napkins, and the like, can fill waste containers in high usage areas in a relatively short period of time. It is inefficient for staff to have to remove full containers more frequently than necessary. Costs associated with large garbage containers, such as may be transported to a dumpsite or emptied into a large truck, tend to vary as the number of times they are filled. In consequence it is advantageous to compact the garbage to lengthen the time interval between removals, and to reduce the cost of dumping the materials.

The use of such machines in a public or quasi-public space, such as in the relatively large garbage containers used in restaurants and shopping malls poses challenges that may not be as prevalent in the small domestic garbage compactors. First, the overall weight of the compacted mass must be kept to a level that is safe for workers, generally in the range of 35 lbs. Some jurisdictions limit the allowable weight of garbage bags to 25 lbs. In one known unit, a system of hydraulic cylinders is used to compress the waste material. In that known system, a unit having an overall size of 51" height, 24 ½" width and 22" depth accomodates a bin that is 19 ¾" deep, 18" wide and 17" high. This system can, under some conditions, compress more than 100 lbs of garbage in a single load. This is well in excess of what an employee is generally expected, or allowed by law in some jurisdictions, to lift.

In general garbage compactors have a receptacle for receiving garbage, and a compression unit for compacting the garbage after a certain amount has been collected in the receptacle. The compression units generally force a platen to extend into the garbage, causing it to compress. It is important that it be highly improbable, preferably impossible, for the compression unit to operate at any time that a person's hands could be caught in the machinery.

The risk of injury is highest in three instances. The first is when a person is emptying garbage into the input chute of the receptacle. The second is when a person is removing collected garbage or cleaning the inside of the unit. The third is when the compaction machinery is in operation. It is also important that objects not become stuck in the input chute when the compression unit is in the middle of operation, such that it cannot retract. Similarly, it is important to be able to extend the compression unit to permit cleaning, without the risk of having the units retract in the middle of the cleaning operation.

A further problem is the tendency of sticky liquids or gums to build up inside the garbage receptacle. In one known machine a solenoid whose purpose was to lock an input chute door during operation compression became gummed over with sticky materials, and in some instances would not lock the door. Another problem with a known machine was that the compression unit had a hinged pressure plate. On the return stroke the hinged plate had a tendency to flip liquids that collected on top of the plate up into the innards of the machinery space. The machinery space was relatively inaccessible for cleaning.

Whereas a homeowner can explicitly decide when to cause a trash compactor to cycle, it may be advantageous for a machine in a public space, a mall, or a restaurant to operate automatically. On one hand customers may not operate the machine when it is required, and on the other hand, they may not operate it correctly in any event, possibly with unfortunate consequences. Further, a person approaching a public garbage receptacle may be carrying a cafeteria tray. It may be awkward for that person to open the garbage chute with one hand while holding the tray with the other. A person may need both hands to carry the tray, particularly if the user is a child. Alternatively, a person having only one arm may find opening the chute and dumping the tray a difficult task. It would be advantageous to have an input chute that opens automatically. However, once the chute is open, it would not be advantageous to have it close while either a tray or a person's hand was still in the chute.

It is known to use a scissors jack mechanism to drive a compression plate, typically downward, into the garbage. Previous scissors jacks have at times shown a tendency to twist or wander, particularly if the garbage has local discontinuities, that is, it compresses more easily on one side than another. If the wander, or tolerance build-up, is too great, the mechanism may ride against the side of the receptacle or other structure. This can lead to wear and damage to the structure, and is undesirable.

SUMMARY OF THE INVENTION

In a first aspect of the invention there is an apparatus for compacting refuse. It has a compression member moveable to compress refuse collected in a receptacle, a drive connected to move the compression member, a structure to which the drive is mounted, and a sensor for gauging the level of refuse in the receptacle. The drive and the compression member are operable in response to a signal from the sensor.

In an additional feature of the invention, the apparatus includes a housing enclosing the compression member, the drive and the sensor. The housing has an accommodation for the receptacle and an inlet for admitting refuse to the receptacle. The apparatus has an inlet closure member operable to lock the inlet during operation of the compression member.

In another additional feature of that aspect of the invention, the apparatus includes the receptacle. In a still further additional feature of the invention, the compression member is moveable to an inactive position. The apparatus includes a proximity sensor connected to cause the inlet closure member to open when the compression member is in the inactive position and the proximity sensor senses an object near the inlet.

In still another further additional feature of the invention, the apparatus is responsive to resistive loading of the compression member by the refuse. In yet another additional feature of the invention, the compression member is constrained by any one of a load limit and a displacement limit.

In still another additional feature of the invention, the compression member is constrained by a receptacle full limit condition. The apparatus has a signaling device for signalling to an operator that the receptacle full limit condition has been reached. In still yet another additional feature of the invention, the apparatus includes a weight sensor mounted to gauge the amount of refuse in the receptacle and the "receptacle full" limit condition is signalled by the weight sensor.

In another additional feature of the invention, the apparatus further comprises a load sensor for gauging the resistance opposing the drive and a sensor for gauging displacement of the compression member. The "receptacle full" limit condition is determined as a function of signals received from the load sensor and from the sensor for gauging displacement of the compression member.

In yet another additional feature of the invention, the compression member is moveable to engage and disengage the refuse. The apparatus has a wiper mounted to discourage refuse from clinging to the compression member when the compression member is disengaged from the refuse. In another additional feature of the invention, the drive is free of hydraulic elements.

In yet another feature of the invention, the drive includes a scissors mechanism having a pair of input legs extending from a common fulcrum. The input legs have input feet mounted to the structure. The mechanism also has a pair of output legs having output feet mounted to the compression member. One of the input feet is mounted to pivot about a first axis whose location is fixed relative to the structure. The compression member is constrained to move in a direction parallel to the bisector of the angle defined between the input legs.

In still yet another feature of the invention, one of the output feet is constrained to pivot about a second axis whose location is fixed relative to the compression member, the first and second axes being parallel. In a further additional feature of the invention, one of the output feet is constrained to pivot about a second axis whose location is fixed relative to the compression member, the first and second axes being parallel and lying in a common plane parallel to the bisector.

In still yet another additional feature of the invention, the drive includes a scissors mechanism having a pair of input feet mounted to the structure and a pair of output feet mounted to the compression member. One of the input feet is constrained to pivot about a first axis whose location is fixed relative to the structure. The other of the input feet is constrained to follow a first linear path lying on a radius from the first axis. One of the output feet is constrained to pivot about a second axis, whose location is fixed relative to the compression member. The other of the output feet is constrained to follow a second linear path lying on a radius from the second axis, the first and second axes being parallel and lying in a common plane, the first and second paths being parallel, the others of the input and output feet both lying to the same side of the plane, the paths being perpendicular to the plane.

In a further additional feature of the invention, the drive comprises a pair of the scissors mechanisms mounted in parallel. In still a further additional feature of the invention, the others of the output feet of the pair of parallel scissors mechanisms each has one of a pair of gears mounted thereto. The gears are mounted to a common shaft parallel to the second axis. Each of the gears is constrained to mesh with a linear rack mounted to the compression member.

In yet a further additional feature of the invention, the drive further includes a motor, a screw driven by the motor, and a yoke engaged to be moved by the screw. The yoke has a screw follower mounted to ride on the screw, a drag member connected to move the other of the input feet and a resilient member mounted to transmit motion between the screw follower and the drag member.

In another aspect of the invention, there is a method of compacting refuse in a refuse receptacle with a compression member, gauging the level of refuse in the receptacle, sending a signal when the refuse is ready to be compressed, moving the compression member to compress the refuse in response to the signal and governing the movement of the compression member according to the resistance presented by the refuse.

In an additional feature of the invention, the step of governing includes monitoring load feedback from the compression member. In another additional feature of the invention, the step of monitoring load feedback includes monitoring the current of a motor driving the compression member.

In a still further additional feature of the invention, the step of moving includes extending the compression member on a compression stroke, and the step of governing includes ending the compression stroke in response to one of the conditions chosen from the set of conditions consisting of (a) a full stroke displacement limit condition; (b) a load limit condition; and (c) a "receptacle full" limit condition.

In a yet further additional feature of the invention, the step of governing includes gauging the weight of refuse in said receptacle. In a still further additional feature of the invention, the method includes the step of preventing more refuse from entering the receptacle when the compression member is in motion. In another further additional feature of the invention, the step of moving the compression member includes returning the compression member to an initial position. In an additional feature, the step of returning includes cushioning the arrival in the initial position.

In a yet further additional feature of the invention, the step of gauging includes the steps of waiting for refuse to be put in said receptacle. In another further feature of the invention, the step of waiting includes the steps of sensing for persons near said receptacle, and opening an accessway to permit refuse to enter the receptacle when persons are near the receptacle.

BRIEF DESCRIPTION OF DRAWINGS

FIG. 9 illustrates another portion of the operating logic of the compactor of FIG. 1.

DETAILED DESCRIPTION OF THE INVENTION

Figure 1:
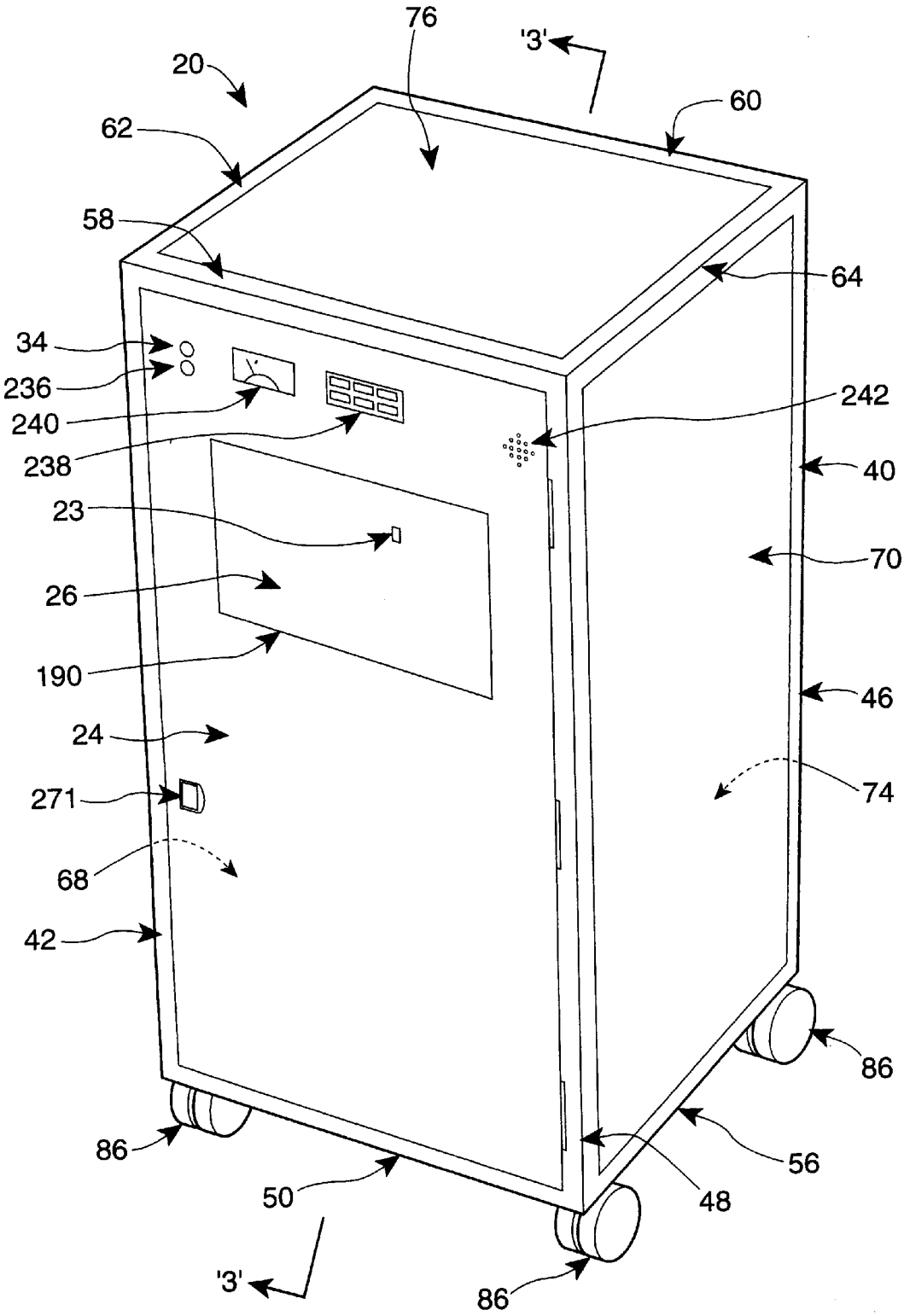
FIG. 1 is a general arrangement isometric view of an example of a compactor according to the present invention as it appears externally.

The description which follows, and the embodiments described therein, are provided by way of illustration of an example of a particular embodiment, or examples of particular embodiment of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

By way of a general conceptual overview, in operation, a person carrying a tray of garbage approaches a garbage compactor unit 20 such as is shown in FIG. 1. A proximity sensor identified as door sensor 22 is mounted to peer through an aperture 23 in the front panel 24 of unit 20 to sense the approach of the tray. When a person approaches unit 20 with a tray, inlet door 26 opens. Garbage introduced at door 26 falls inside unit 20 to collect in a receptacle in the nature of a stainless steel garbage bin 28 that has a liner, or bag 29 for collecting refuse. After a number of such deposits the loose pile of garbage in bin 28 will be sufficiently high to activate a pile sensor 30. A compression unit in the nature of a scissors jack mechanism 32 is then extended to compress the garbage. Once the compression is complete, mechanism 32 and awaits the next filling before compressing the garbage again. When the unit reaches a full condition, an annunciator, or signalling device in the nature of a signal light 34, signals for an operator to open front panel 24, which is hinged to form a door, to remove the collected garbage. Unit 20 has overall dimensions of 24" width, 24" depth, and 50" height. A more detailed description of the structure and operation of unit 20 is given below.

Figure 2A:
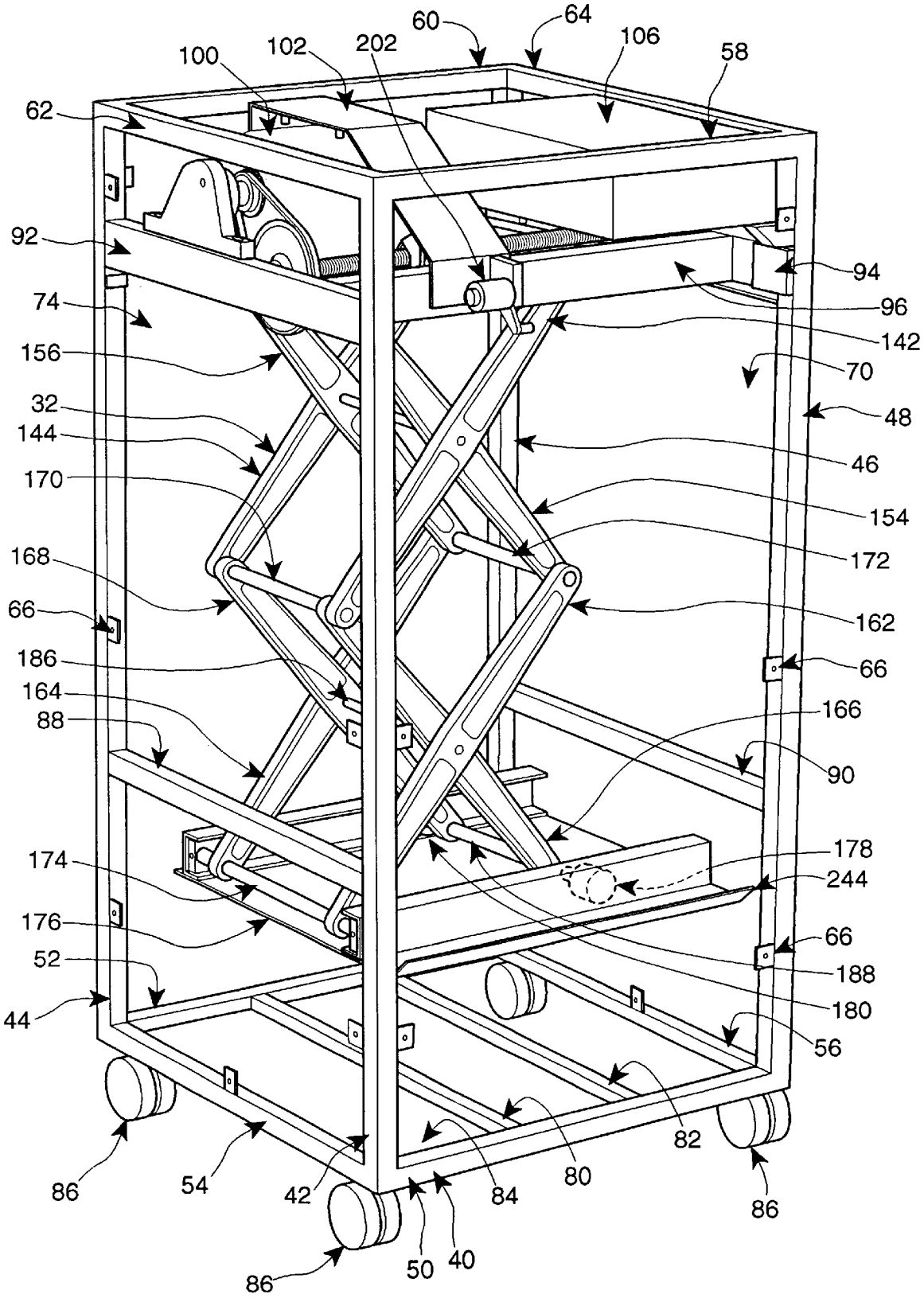
FIG. 2*a* is a view of the compactor of FIG. 1 with portions of its external panelling removed to expose the internal structure of the compactor in an extended position.
Figure 2B:
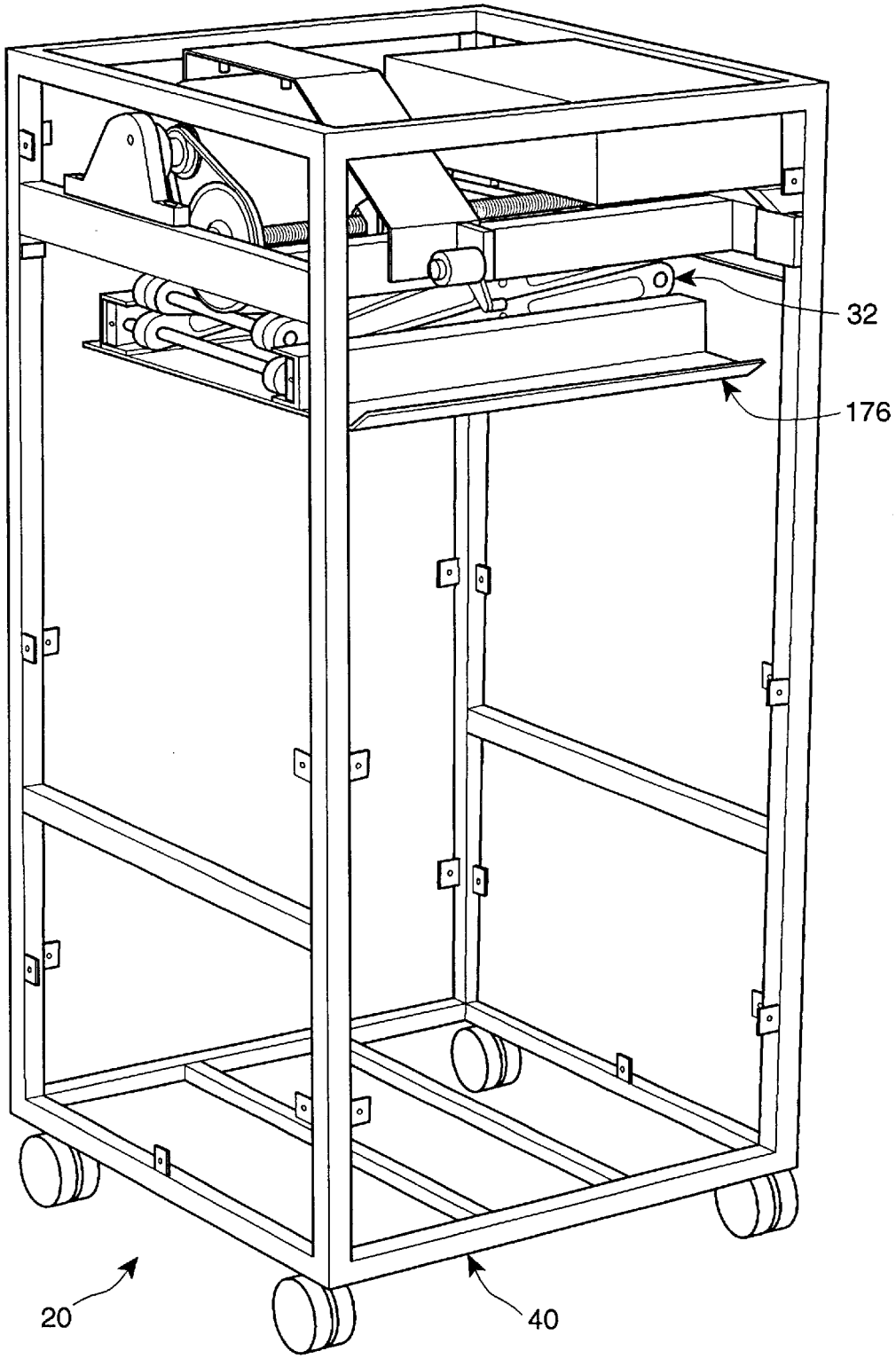
FIG. 2*b* is a view of the compactor of FIG. 1 with portions of its external panelling removed to expose the internal structure of the compactor in a retracted position.

The description begins with FIGS. 1, 2*a* and 2*b* in which near surface panels have been removed to expose internal elements. The basic structural skeleton of unit 20 is a support structure in the nature of a frame 40 that has four hollow square steel tube corner uprights 42, 44, 46, and 48 whose bottom ends are joined by lower front, rear and side peripheral tube members 50, 52, 54, and 56, and whose top ends are joined by upper front, rear and side peripheral tube members 58, 60, 62 and 64. Frame 40 has mounting tabs, 66 to permit the mounting of the outer casing made up of left and right hand side panels 68 and 70, front panel 24, rear panel 74, and top panel 76. When assembled, unit 20 forms an enclosure, or housing, that has a space, or accommodation, in which a receptacle for accumulating refuse, such as bin 28, can be received. Frame 40 has a pair of intermediate cross bars, in the nature of ribs 80 and 82, extending between lower front and rear peripheral tube members 50 and 52 to support bin 28, and to carry, on their lower face, a bottom closure panel 84. When unit is in operation, ribs 80 and 82 carry the reaction force on bin 28 to the other members of frame 40. This load path forms a closed loop since the other end of the compression unit is also mounted, ultimately, to frame 40 as will be described below. Thus the force compression is contained within unit 20, and is not passed to the ground. Frame 40 itself rests on rollers 86 mounted at each corner, although it could rest on non-rolling feet. A pair of sidewall cross supports 88 and 90 extend between uprights 42, 44 and 46, 48 repectively.

Mechanism 32 is also mounted to frame 40. A pair of relatively deep main left and night hand for-and-aft stringers 92 and 94 are mounted to uprights 42, 44 and 46, 48 at a level corresponding generally to the upper extremity of inlet door 26. A pair of generally parallel front and rear main cross braces 96 and 98 span the distance between stringers 92 and 94, inset asymmetrically from uprights 42 through 48, such that a centreline drawn between, and parallel to braces 96 and 98 is closer to the back of unit 20 than to the front. A main motor 100 is mounted to a motor mount 102 that extends like a bridge between braces 96 and 98. A motor belt tensioning strut is indicated as 104 and extends between brace 96 and motor 100. Also mounted across braces 96 and 98 is a controller enclosure 106 that houses the programmable logic circuitry that controls operation of unit 20. Enclosure 106 is removable as a module for repair, maintenance and upgrade as required.

Figure 5:
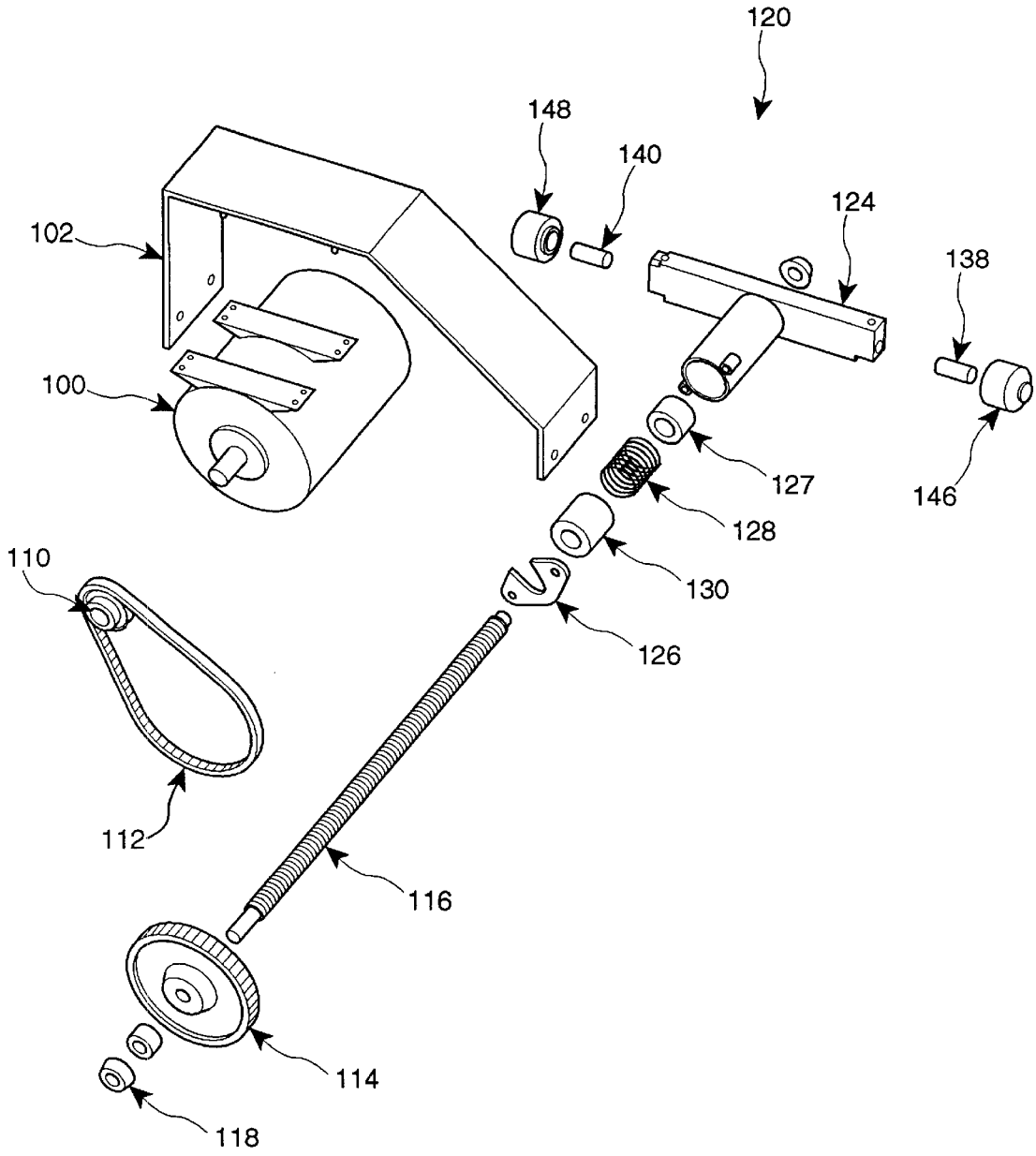
FIG. 5 is an isometric exploded view of elements of the drive system of the compactor of FIG. 1.

A more detailed description of the drive train is best understood with reference to FIGS. 2*a*, 2*b* and 5. Motor 100 is slung from mount 102 and supported by braces 96 and 98 as noted above, in a position to be concealed behind front panel 24 and below top panel 76. It is located within the enclosure envelope of unit 20 in the location least likely to accumulate splattered material. Motor 100 is a ½ h.p. reversible, 4 pole single phase induction electric motor with a nominal speed of 1725 r.p.m. It turns a small pulley 110 which is linked by a tiling belt 112 to a driven sheave 114. The speed reduction in this step has a ratio of 1:3. Sheave 114 is mounted to turn a jack screw 116. Jack screw 116 is a ¾" acme screw having 6 threads per inch. It is carried in bearings 118 at either end mounted in stringers 92 and 94.

Figure 6:
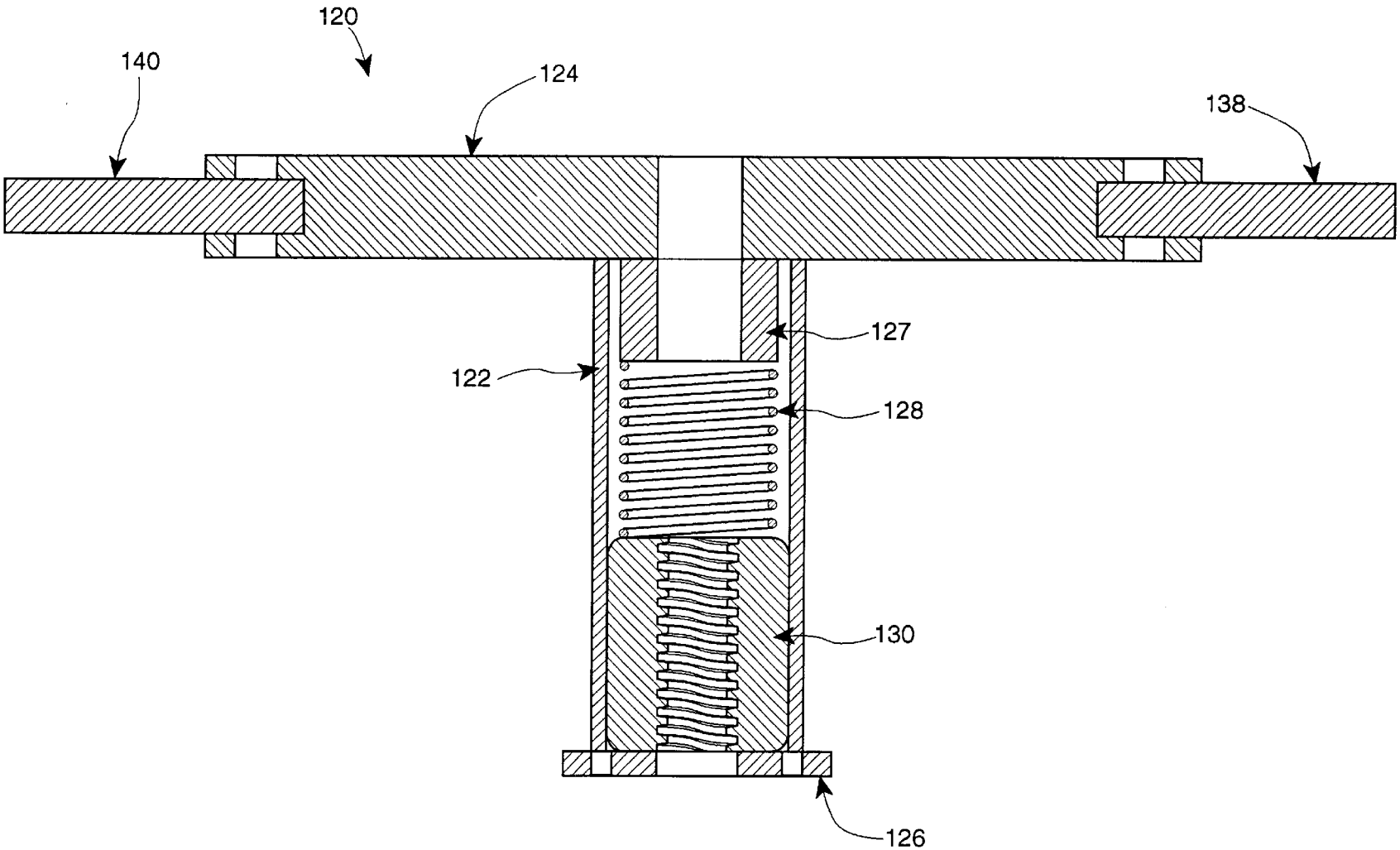
FIG. 6 is a cross section of some of the drive elements of FIG. 5 as assembled.

Mounted in threaded engagement with jack screw 116 is a crosshead yoke assembly 120, shown in the exploded detail of FIG. 5 and in the cross-section of FIG. 6. It has a socket formed by mounting a sleeve 122 perpendicularly to a transverse yoke beam 124. A capture plate 126 is attachable at the bolt bosses of sleeve 122 to capture a spacer, 127, a resilient cushioning member in the nature of a spring 128, and a screw follower, or screw engaging member in the nature of a Delrin (T.M.) nut 130. As assembled, nut 130 functions as a screw follower, and the reminder of assembly 120 acts as a drag member for governing the motion of whatever is attached to the ends of yoke beam 124. Spring 128 is located to transmit motion, in at least one direction, between the screw follower, nut 130, and the drag member.

When the drive system its returning to its initial, retracted position, the notched portions of beam 124, activate a microswitch 134 mounted to brace 98 to cause the unit to stop. In the time delay while this occurs and motor 100 decelerates, nut 130 will continue to travel, but will slow down as it compresses spring 128. The presence of spring 128 causes the stop to occur more smoothly, and over a longer period of time, than might otherwise be the case. It discourages the jerking motion sometimes seen with this kind of equipment. A through bore through all of assembly 120 accommodates screw 116. In an alternative embodiment, springs can be placed to either side of Delrin (T.M.) nut 130 to cushion motion in both directions.

Transverse yoke beam 124 has, mounted at either end thereof stub shafting 138 and 140 at either end, upon which a pair of primary translating arms in the nature of front and rear first scissor arm links 142 and 144 are mounted in bushings. At the outer extremities of yoke beam 124 are a pair of front and rear upper cam followers in the nature of rollers 146 and 148, that ride along respecting front and rear upper cam tracks 150 and 152. Cross braces 96 and 98 are channel shaped sections with mutually inwardly facing toes such that the profile of the channel itself yields tracks 150 and 152.

A pair of front and rear primary pivoting arms 154 and 156 are mounted to pivot at one end on bushings mounted at fixed pivot points spaced apart on a common pivot axis shaft 158 perpendicular to jack screw 116 and cam tracks 150 and 152 such that the linear path of the centers of rollers 146 and 148 lies on a radius extending perpendicularly away from the axis of shaft 158. Pivoting arms 154 and 156 are linked to scissor arm links 142 and 144 by a primary fulcrum pivot shaft 160 located midway between the respective ends of link 142, 144, and arms 154 and 156. In the preferred embodiment fulcrum shaft 160 is located at the mid-point of each of the repective arms, but this is not a necessary condition for the operation of such scissors devices in general.

Figure 3:
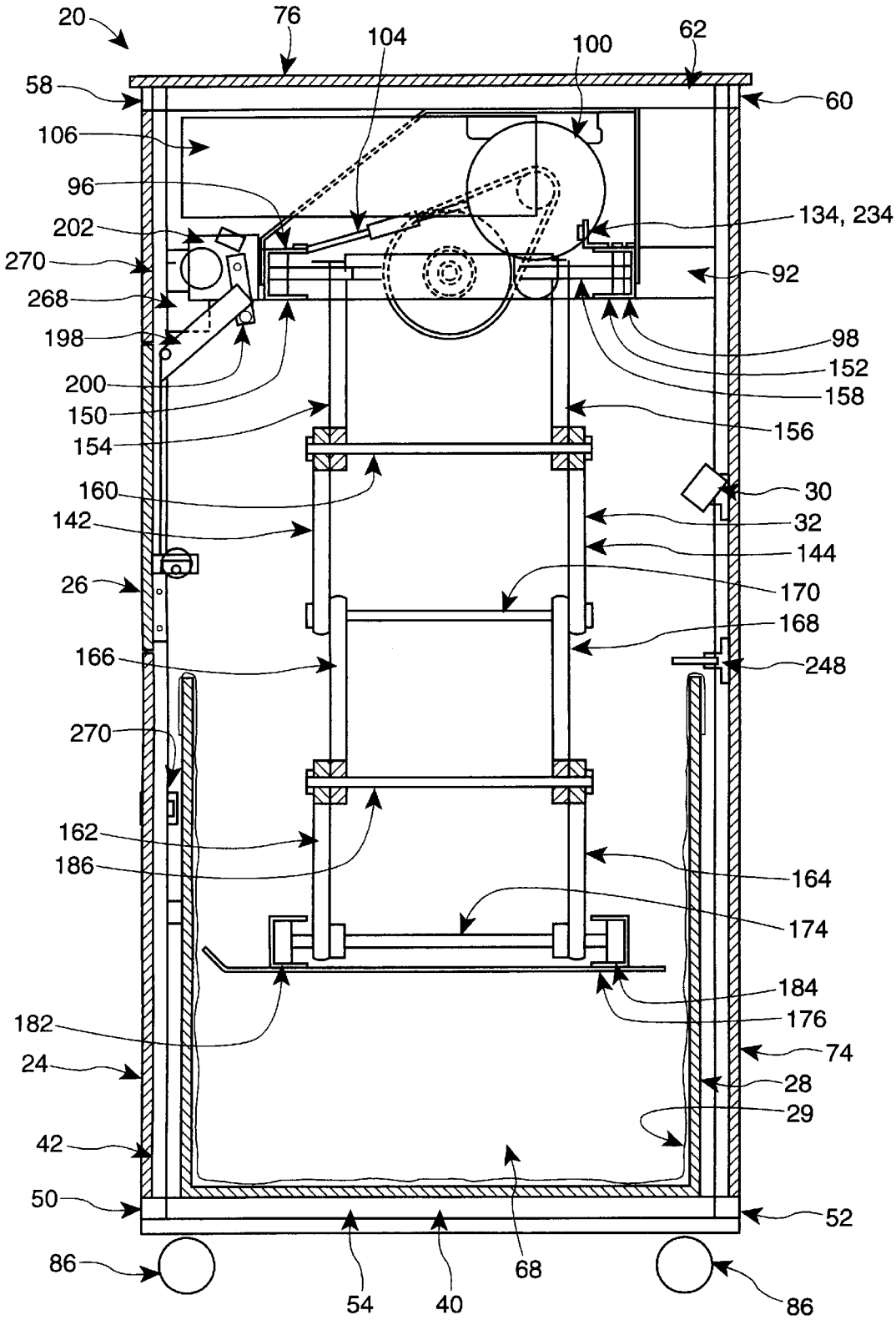
FIG. 3 is a cross-section of the compactor of FIG. 1 taken at section '3—3', and showing the structure of a door mechanism.

Connected in folding-accordion fashion to the distal ends of arms 154 and 156 and links 142 and 144, are respective front and rear secondary pivoting arms 162 and 164, and secondary translating links 166 and 168. These pairs of arms are also cross linked at their respetive end joints by intermediate pivot shafts 170 and 172. As shown in FIG. 3 arms 162 and 164 are stepped outward from arms 154 and 156 to lie generally in the same respective vertical planes as links 142 and 144. Similarly, links 166 and 168 are stepped inwardly of links 142 and 144 to lie in the same respective vertical planes as arms 154 and 156. At their most extreme points, arms 162 and 164 are pivotally mounted in fixed location bushings on a common shaft 174 mounted to the upper side of a compression member in the nature of a pressure plate 176. Links 166 and 168 have outwardly extending stub shafts and rollers 178 and 180 that are engaged in slides, in the nature of trackways 182 and 184 formed from channels mounted to the upper face of pressure plate 176. Rollers 178 and 180 share a common shaft 188. As above, secondary arms 162 and 164 and secondary links 166 and 168 cross in scissors like fashion. They are linked on a common fulcrum axis by secondary fulcrum shaft 186.

As illustrated, shafts 138, 140, 158, 160, 170, 172, 174, 186 and 188 are all intended to be parallel. Shafts 138, 140, 172 and 188 are coplanar. Shafts 158, 170 and 174 are coplanar. Shafts 160 and 186 are coplanar. The linear paths traced by the center of rollers 178 and 180 lie on radii extending perpendicular to the axis of shaft 174. From this geometry, the paths of trackways 150, 152, 182 and 184 are all mutually parallel, and perpendicular to the axes of the various Shafts. For this geometry the direction of extension and retraction of pressure plate will be in a direction parallel to the bisector of the angle at fulcrum shaft 160 defined between the legs of line 142 (or 144) and arm 154 (or 156) that have feet constrained, respectively to pivot about shaft 158 and to follow the linear path of trackways 150 and 152.

Also, in the case of the geometry illustrated, this bisector will lie in the plane of the axes of shaft 160 and 186. The pivot axes 158 and 174, respectively fixed in location relative to the support structure of braces 96 and 98, and to pressure plate 176, always lie to one side of this plane. The axes of rollers 146, 148, 178 and 180 which are constrained to follow the linear paths of their respective trackways, always lie to the other side of the bisector plane. Furthermore, as shown, the bisector plane is perpendicular to the linear travel of the rollers in the trackways. While the geometry of linkages of this type can be varied, the inventors have found it convenient for the fulcrums to be located at the mid point of the members (that is items 142, 144, 154, 156, 162, 164, 166 and 168), and for the members to be of equal lengths.

Given the mechanical relationship of motor 100, jackscrew 116 and scissor mechanism 32 generally as described above, forward operation of motor 100 to drive sheave 114 will tend to draw crosshead yoke assembly 120 toward the axis of shaft 158, extending scissor mechanism 32. The vertical force exerted by plate 176 for a given torque in jackscrew 116 will tend to increase as the arms and links extend. As pressure plate 176 encounters more resistance in compressing garbage, at whatever height, motor 100 will tend to draw a greater current and produce a greater torque until the chosen current limit is reached. This load can be measured directly, with load cells or other devices, or it can be measured indirectly by measuring motor current to give suitable feedback.

Whether the scissors mechanism is a single scissors mechanism having a single fulcrum axis, a double scissors mechanism having two fulcrum axes as illustrated, or a multiple scissors mechanism having a larger number of fulcrum axes, scissors mechanisms have, in general, an input end having a pair of legs extending from a common fulcrum axis, and an output pair of members, arms, or fingers, extending from a fulcrum axis. In the case of a single scissors mechanism, the fulcrum axis will be the same in both instances. The legs at the input end will have feet or toes, that are alternately drawn together to extend the mechanism, and driven apart to retract it. At the output, there are feet mounted to a device to be extended.

In the preferred embodiment the input feet are the ends of input arms 154 and 156 that are constrained to pivot about the axis of shaft 158, and the ends of links 142 and 144 that are constrained to follow the linear pat traced by rollers 146 and 148 along trackways 150 and 152. The output feet are the ends of the secondary pivoting arms 162 and 164, constrained to pivot about the axis of shaft 174, and the ends of secondary translating links 166 and 168 that are constrained to follow the bear path of rollers 178 and 180 in trackways 182 and 184.

It would be possible to use only one scissors mechanism, but lateral stiffness is improved by mounting two such systems in spaced apart parallel relationship, as shown in the preferred embodiment. That is, the front mechanism, which includes arm 154, is parallel to the rearward mechanism, which includes arm 156. It would also be possible to use a different kind of compression unit, whether a mechanism that depends on gears, hydraulics, or a vertical screw driving a plate. Unit 20 is intended to provide a moderate amount of compaction to relatively loose, mostly paper garbage of the kind found, for example, in malls and at fast food restaurants and the like. The electrically driven scissors mechanism of FIG. 3 is preferred, since it permits unit 20 to be free of a hydraulic system and hydraulic fluid.

The fixed axes of shafts 158 and 174 will tend to reduce the tendency of plate 176 to twist as compression occurs, as compared to a scissors mechanism in which both sides are permitted to travel. A reduction in twisting is desirable, since it reduces the probability that plate 176 will ride against, and damage, the inner walls of bin 28. Such twisting can further be discouraged by the use of gears and torque tubes, as noted below since this will tend to compel the legs, that is the translating links, to advance in their trackways at the same rate.

Figure 4:
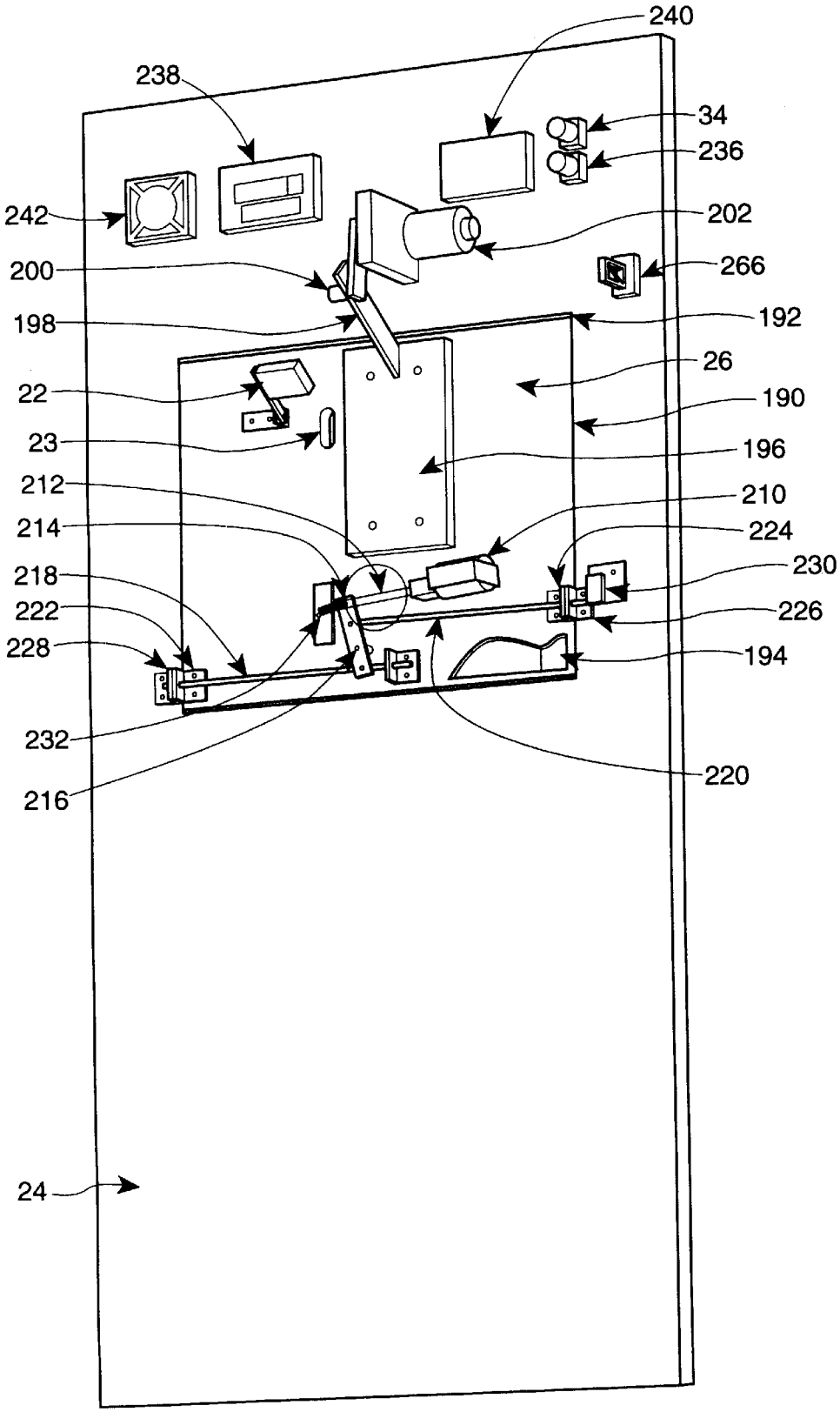
FIG. 4 is a three quarter view of a door panel of the compactor of FIG. 1.

Operation of mechanic 32 occurs after garbage has been deposited through inlet door 26 of front panel 24. FIG. 4 shows the inner face of front panel 24. A generally rectangular opening 190 is defined in the upper region of panel 24, and a door 26, of a size to mate with opening 190 pivots inwardly and upwardly of panel 24 about a hinge 192 extending along the upper margin of door 26 and opening 190. A scrap section of a door covering 194 is shown. For the purposes of explanatory illustration cover 194 has been removed except for the partial section indicated. In actual use covering 194 covers all of the working parts mounted to door 26, as described below, to discourage the accumulation of sticky materials on them.

Figure 8:
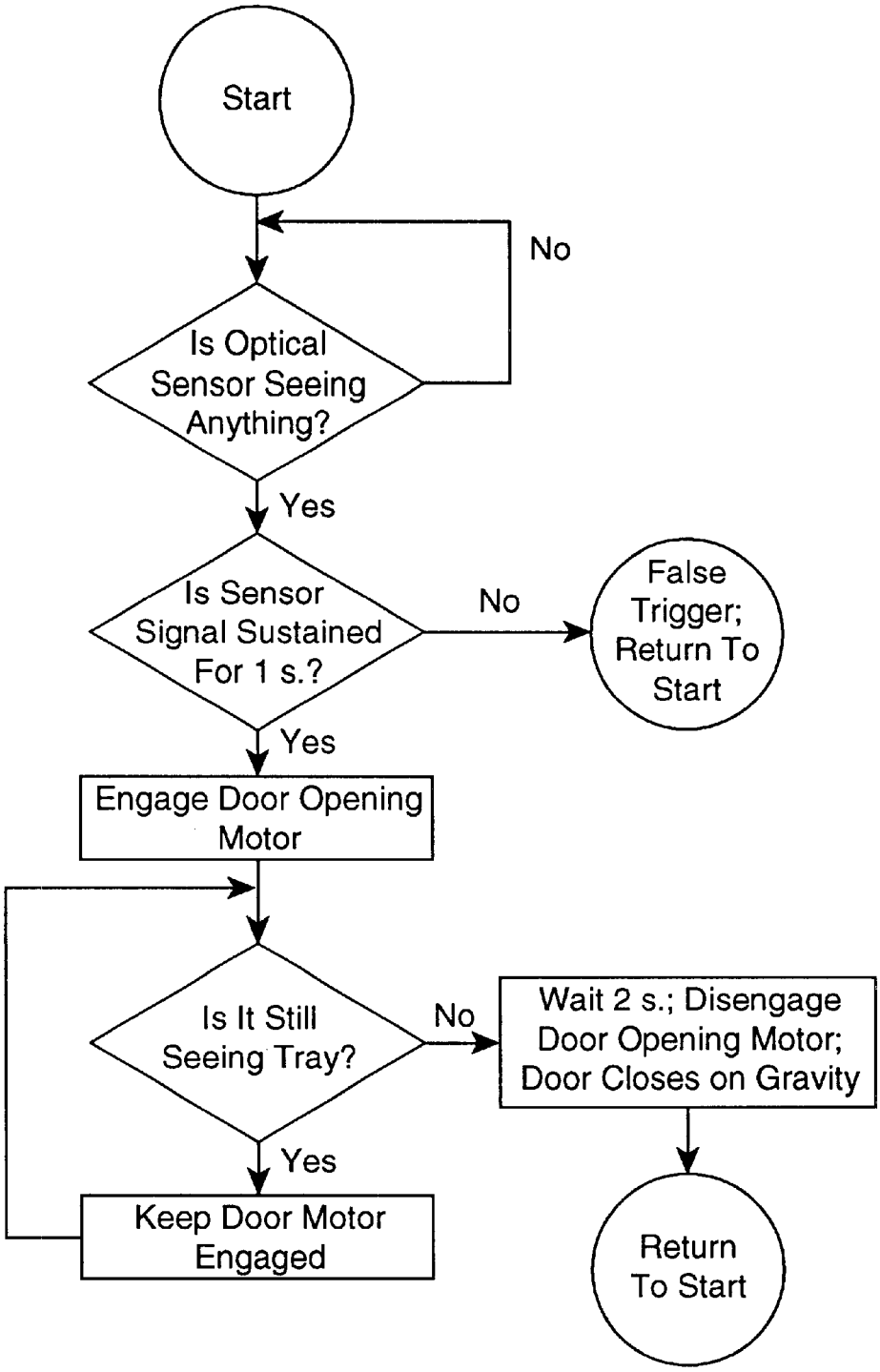
FIG. 8 illustrates a portion of the operating logic of the compactor of FIG. 1.

Located on the upper portion of door 26 is a cam follower made of a bracket 196 fastened to door 26 by rivets, screws or other means. Bracket 1% has an inwardly and upwardly extending arm 198. An actuator arm 200 is mounted to frame 40 and is driven by a door motor and driving linkage 202 provided that the compression member is in its retracted, or inactive position, when door sensor 22 senses that a person is approaching to dump garbage, actuator arm 200 is driven forward to engage inwardly extending arm 198. Although actuator arm 200 and door motor and linkage 202 are mounted to motor mount 102 in front of brace 96, they are shown in FIG. 4 to illustrate the spatial relationship to arm 198. As the motion continues, inwardly extending arm 198 rides against actuator arm 200 as a cam follower follows a cam, until door 26 reaches its fully open position. Door 26 is held in the fully open position as long as sensor 22 is activated. When sensor 22 is deactivated, and after a time delay of 2.0 seconds actuator arm 200 is returned to its initial, inactive position. Notably, door 26 is not driven closed to lessen the probability of catching a person's fingers. If a person's fingers are still in the door, then only the weight of the door will bear against them. The logic of this process is set out in the flow chart of FIG. 8.

On the lower inside portion of door 26 there is a solenoid 210 arranged to extend or retract a connecting rod 212. Connecting rod 212 bears upon a crank 214 mounted to pivot about a fulcrum 216. A pair of links 218 and 220 each have one end mounted to crank 214, one between fulcrum 216 and rod 212, and the other being to the other side of fulcrum 216. The distal ends of links 218 and 220 are restrained by a slide 222 or 224 respectively. Slides 222 and 224 are located to place the distal ends of links 218 and 220 opposite to a pair of door lock sockets 226 and 228 mounted on the inside face of panel 26. In the general case, when pile sensor 30 has not received a high garbage signal, solenoid 210 is inactive. Its coil is not energized, and so its body is relatively cool. When it is activated, rod 212 is forced outward to turn crank 214 about fulcrum 216, in tun driving links 218 and 220 outward through slides 222 and 224, and into locking engagement in sockets 226 and 228. Notably, unlike a known type of garbage compactor in which a solenoid is used to engage a locking socket, neither slides 222 and 224 nor sockets 226 and 228 is hot so the tendency for sticky liquids to dry and become encrusted is reduced. Solenoid 210 does become warm when cycled "On", but is less exposed.

As noted above, scissors mechanism 32 will not be activated until door 26 is locked closed. To achievet is, a full travel microswitch 230 is mounted to front panel 24 and is activated when the locking mechanism is driven filly home. Rod 212 has a return spring 232 to urge links 218 and 220 toward their disengaged position when solenoid 210 is deactivated. Although the mechanism shown is preferred, other types of door locking mechanism could be used, including other arrangements of cables, bell cranks connecting rods and similar door closure and locking means.

Also as noted above, unit 20 includes a pile sensor for sensing the height of the pile of garbage in bin 28. Pile sensor 30 is mounted to frame 40 at an angle to rear panel 74 of unit 20. It is aimed to sense pile height closer to the rear of bin 28 than to the front, on the general assumption that the trajectory of the garbage entering through door 26 will generally result in a pile that is deeper toward the back than toward the front. Pile sensor 30 is a background suppressed sensor. It is looking for a pile height that is nominally 16 inches, as indicated in FIG. 9. However, it will be understood that loose garbage is unlikely to collect in a level manner at a precise height. Rather, there will be a random variation of height within bin 28. The pile sensor does not rely on brightness of reflection, since that may vary according to the reflectivity of the particular object. Instead, sensor 30 has a pair of beams that cross at a focus, such that the device detects whether any object is present, rather than how bright the reflection may be. Pile sensor 30 provides a means for gauging the level of refuse in the receptacle in an approximate manner.

As reflected in the logic of FIG. 9, when an object is detected by pile sensor 30, the system tests to make sure that the signal persists for a significant period of time, at least 5 seconds in the preferred embodiment, to allow the garbage to settle somewhat. If the sensor sill senses the presence of garbage after 5 seconds then a signal is sent to lock door 26 in the closed position. Once it is confirmed that door 26 is locked then the compression unit is activated in response to the signal from pile sensor 30. Motor 100 begins to drive jack screw 116 to extend mechanism 32, carrying pressure plate 176 downward as it does so.

The time of operation of motor 100, and its current draw are monitored. The extension (and retraction) can occur in any of three regimes. First, if motor 100 operates for less than 3 seconds, and yet the current draw is 120% of the design rated current draw, then the controller infers that bin 28 is full. Jack screw 116 is tumid in the other direction, and the "receptacle full" signal light 34 is activated to tell staff to empty bin 28.

The second regime is a load limited regime. If the motor current then increases to exceed the preset value, then the controller infers that plate 176 has encountered material, and has compacted it enough to reach the desired density. In that case the extension stroke ends, plate 176 is retracted to its initial, or inactive stored position, and unit 20 goes into a waiting mode until sensor 30 again senses material. The use of a load limit in this way may tend to encourage longer motor life.

In the third regime, if motor 100 current does not reach the limiting value, then a fill travel microswitch 234, mounted to brace 98, will be activated by the notched end of yoke beam 124 when plate 176 reaches fill stroke displacement limit. Microswitches 134 and 234 are mounted in line, roughly 8 inches apart, on brace 98. In the preferred embodiment the full stroke displacement limit corresponds to 90% of fill stroke length that would occur if the mechanism were allowed to advance until the scissor arms jammed. The microswitch can be set to be tripped by plate 176, or by some part of mechanism 32 or by counting the number of turns of motor 100, or any other suitable means. It is preferred to measure the travel of the sleeve on the jack screw, since this part of the mechanism is less likely to accumulate splattered material. In the event that microswitch 234 is tripped, the logical inference is that bin 28 is almost empty. Plate 176 is then retracted to its rest position above the level of door 26.

When the full condition is reached, signal light 34 on the front console of the unit is illuminated, to notify the operator to empty bin 28. In an optional embodiment the motor controller can count the elapsed time to end of stroke on a current based limit, and when it is less than, for example, 3 seconds, a light 236 of one color, such as yellow, can be illuminated to warn the operator that bin 28 is almost full, and a red light, such as signal light 34 can be illuminated when the "receptacle full" condition is reached. Although the simple light is preferred, a number of other means could be used alternatively or additionally for indicating the amount of garbage collected in the receptacle. Either an LED display 238 showing the percentage of fullness or a direct weight measurement, or a gauge 240 with a pointer on a scale, or similar mechanical or electrical system, or a speaking synthesized voice system 242 could be used. An annunciator, or signalling device, in the form of a single glowing light is a relatively simple solution, and is preferred for its simplicity.

It should be noted that the programmable controller polls the status of door sensor 22 and pile sensor 30 continuously. If one of these becomes active, then operation of the other part of the system is inhibited. That is, if the compactor is operating, door 26 will not be opened, whatever sensor 22 may indicate. Similarly, if door 26 is being held open in response to a signal from sensor 22, the compaction unit will be disabled while door 26 is open. If the controller senses input signals that are contradictory, then it inhibits both door 26 and scissors mechanism 32 from working, and displays a fault warning instead. This fault warning can be a flashing light signal, as from light 34, or a fault code display on LED display 238, or by use of some similar audio or visual warning means. If one of the sensors becomes inoperative, as for example, if pile sensor 30 were to be covered with ketchup, then a warning signal is displayed accordingly.

Figure 7:
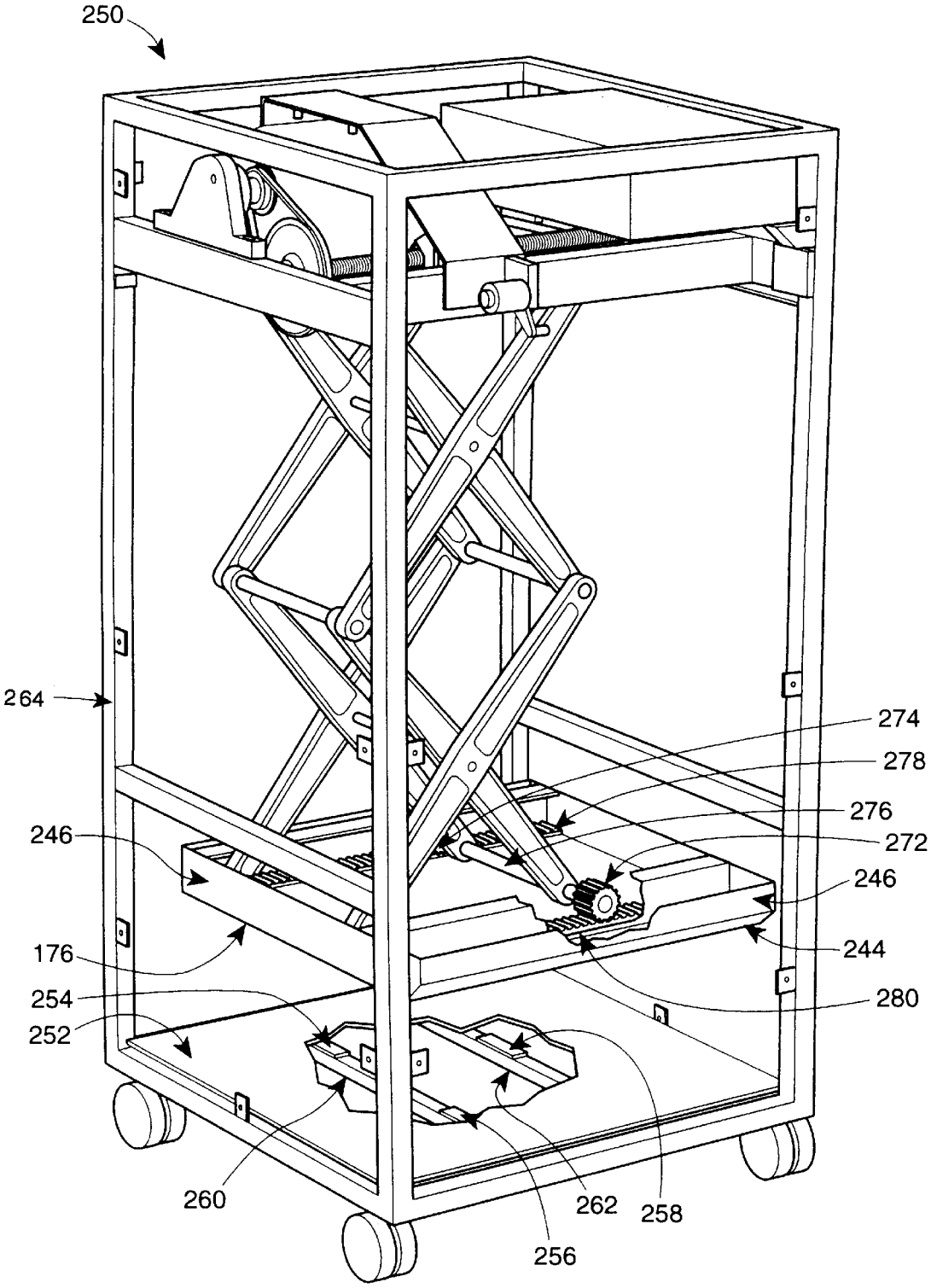
FIG. 7 shows an alternate embodiment of the compactor of FIG. 3.

Pressure plate 176 has an upwardly bent lip 244 along its front edge. In an alternative embodiment as illustrated in FIG. 7, the entire periphery of pressure plate 176 has an upwardly extending lip or skirt 246 to discourage material from accumulating on top of plate 176. In addition, an inwardly oriented flexible wiper 248 (shown in FIG. 3) is mounted to the inside faces of front panel 24, rear panel 74, left hand side panel 68 and right hand side panel 70 at a level roughly corresponding to the top of inlet door 26, close to the upper limit of the retraction stroke of pressure plate 176. As plate 176 rises, wiper 248 is intended to encourage cups, napkins and other material that may have become caught on the edges of plate 176 to be stripped off. Wiper 248 can have bristles, or be made of a rubber strip, or have a plurality of inwardly oriented flexible fingers that deflect as plate 176 passes.

As noted above, the fullness of bin 28 can be inferred by a direct weight measurement. This provides a second means to increase the tendency to stay within the local weight limit. Furthermore, it permits the weight in bin 28 to be recorded by the programmable logic controller as a function of time. In normal use the weight in bin 28 will increase relatively slowly. A sudden increase in weight could indicate that matter has been dumped in bin 28 that may not be suitable for compression. As illustrated in the optional alternative embodiment of compactor 250 of FIG. 7, the support for bin 28 is provided by a floor panel 252 shown in scrap section to reveal three load cells 254, 256, and 258 upon which floor panel 252 rests. Load cells 254, 256, and 258 are in turn mounted in a three point triangular array to ribs 260 and 262 that complete the load path to frame 264 generally. (The remainder of frame 264 is, unless noted otherwise, the same as frame 40). The increase in the sum of the values sensed at load cells 254, 256, and 258 over the empty weight of bin 28 will yield the weight of refuse in bin 28. More than three load cells could be used if desired. Although other, mechanical weigh scale systems could also be used, load cells are capable of withstanding the loads imposed during compression of the refuse in bin 28, (in the range of 600 to 1000 Lbs.) and yet provide sufficiently accurate discrimination of smaller weights in the 0 to 50 Lbs. range. The signals from the load cells and their variation with time are monitored and the result displayed on display 238. In the event of a sudden increase in weight, such as a jump in excess of 3 Lbs., display 238 can be used to provide a fault warning to the operator, and to prevent further operation of the compression unit until the contents of bin 28 have been examined.

Whether activated inferentially as in the first regime described above, or directly by a weight measurement, when the "receptacle full" signal is given, it is intended that an operator will empty out the collected garbage and return an empty receptacle for the next load. Front panel 24 has mounted to it a contact in the nature of an electrically conductive key 266 that fits in a mating socket 268 mounted to doorjamb 270. If an electrical connection is not made through key 266 and lock 268, power cannot reach motor 100. It is intended that it not be possible to operate motor 100 when front panel 24 is open. When an operator unlocks and opens door handle 271, front panel 24 swings outward, withdrawing key 266 from socket 268, and breaking the main power circuit to motor 100.

It is possible to achieve this in a number of alternative ways. For example a logic system could be used to sense the position of the door, and, through software or relays, prevent the motor from being activated. Alternatively microswitches could be mounted either at the hinge or at the closure of front panel 24. The engaging electrified lock is preferred because, unlike some microswitches, it is relatively difficult, if not impossible, to fool or tape closed. Further, it is not vulnerable to a software failure. With the power shut off so that motor 100 cannot run, it is safe to reach inside and remove bin 28, to remove the full bag 29 and to replace it with a new bag. Although front panel 24 is shown with hinges along the right hand side, the arrangement of the hinges, handle 271, key 266 and socket 268 could be reversed to permit front panel 24 to swing to the other side.

In the alternative embodiment illustrated in FIG. 7, rollers 168 and 170 can be replaced by gears 272 and 274 joined by a shaft or torque tube 276, and trackways 172 and 174 can be replaced by toothed racks 278 and 280. In this alternative embodiment, the rack and gear arrangement further encourages the arms to move equally on left and right hand sides, further discouraging the tendency of the scissors mechanism, and particularly pressure plate 176, to twist as garbage is compressed.

Figure 10:
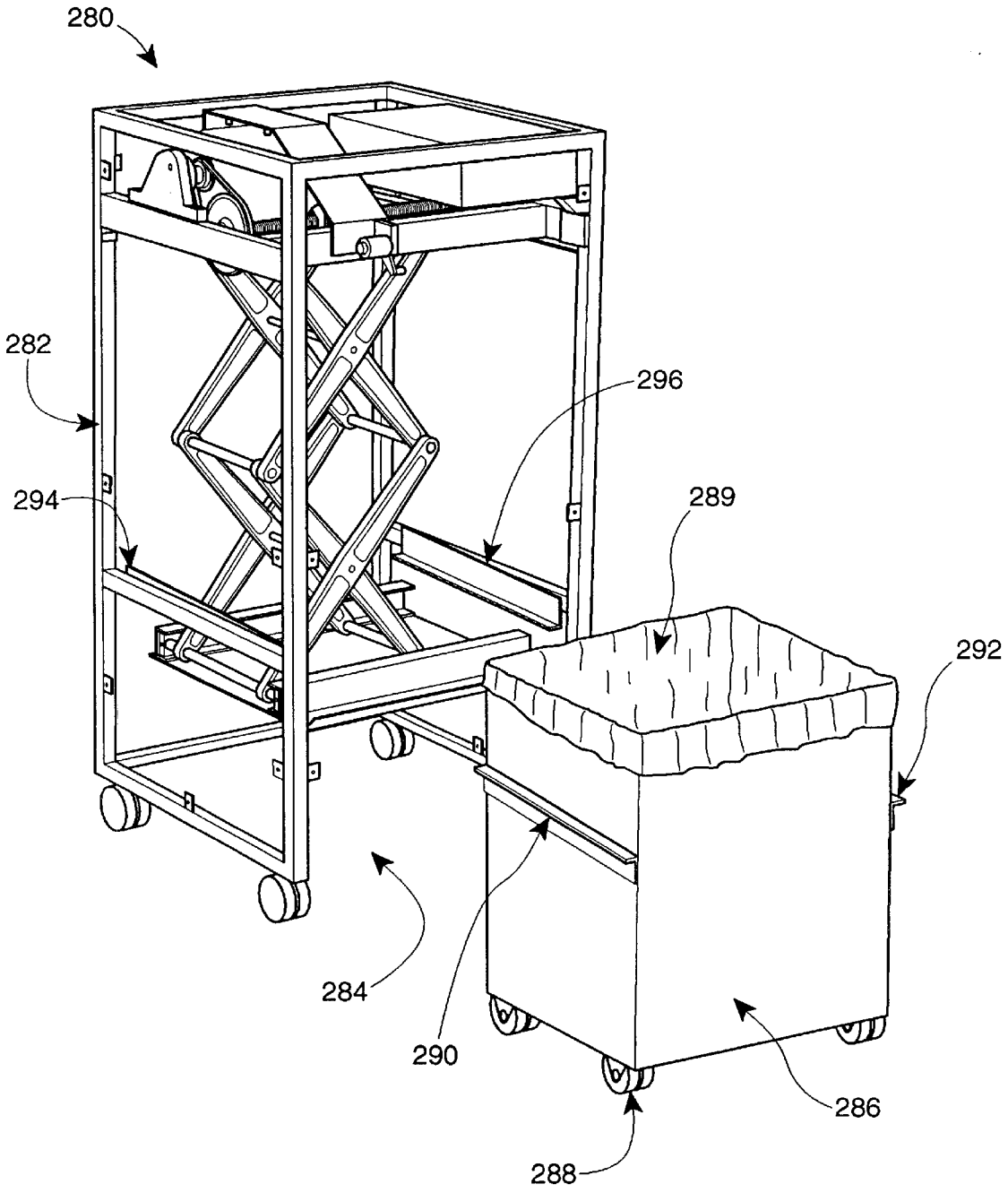
FIG. 10 illustrates a lower portion of an alternative embodiment of a waste compactor for co-operation with a rolling bin.

In another alternative embodiment of the invention, as shown in FIG. 10, a compactor unit 280 has a frame 282 that differs from frame 40 of the preferred embodiment of FIG. 2, in that front lower peripheral member 50 has been removed, leaving a U-shaped entranceway 284. This permits use of a bin 286 mounted on wheels 288 as shown, so that a person emptying unit 280 can roll the existing load away, and replace bin 286 with an empty bin. Bin 286 can then be rolled to the nest dumpster, bag 289 can be removed, and a new bag put in place.

Bin 286 is equipped with frame engagement members in the nature of inclined side flanges 290 and 292. These engage, and ride upon, receptacle engaging members in the nature of inclined flanges 294 and 296 that have an angle of incline of 3 to 4 degrees. For the last few inches of travel, the entire weight of bin 286 is lifted off wheels 288, and carried by flanges 294 and 296 instead. Flanges 294 and 296 can be mounted directly to cross supports 88 and 90, or can be mounted to load cells mounted on supports 88 and 90, to permit the weight of garbage to be monitored over time. In use, the force during the compaction cycle holds bin 286 firmly in place on flanges 294 and 296. The location of bin 286 in suitable position is further assured by the position of front panel 24, which, when closed, limits the movement of bin 286. Other engagement means could be used, including detent catches, wheels chocks, latches, and other similar mechanical devices.

It is not necessary that the access panel for removing full bins be the front panel of the unit. Either the side or back faces could be used. However, it is preferred that the front face be used as this permits several units to be lined up side by side or back to back. Equally, although the preferred scissors jack mechanism, 32, is shown as a double scissors jack (that is, is has an upper, or primary scissor pair which transmits motion to a lower, or secondary scissor pair), it could be made in a single scissor, or a multi-scissor unit, depending on the space available and the stroke to be achieved. It is, or course, not necessary that a scissors jack be used. A geared system or a compacting screw, or a hydraulic system could be used. However, a mechanical linkage system, such as scissors jack 32 is preferred since it permits the elimination of the need for a hydraulic system.

Various embodiments of the invention have now been described in detail. Since changes in and/or additions to the above-described best mode may be made without departing from the nature, spirit or scope of the invention, the invention is not to be limited to said details, but only by the appended claims.

We is claimed is:

1. An apparatus for compacting refuse, comprising:

a compression member moveable to compress refuse collected in a receptacle;

a drive connected to move said compression member;

a sensor for gauging the level of refuse in the receptacle;

a structure to which said drive is mounted, said structure including a housing enclosing said drive, said compression member and said sensor, said housing defining an enclosure having a space for accommodating the receptacle;

said drive and said compression member being operable in response to a signal from said sensor;

said drive including a scissors mechanism having a pair of input legs extending from a common fulcrum, said input legs having input feet mounted to said structure, and a pair of output legs having output feet mounted to said compression member;

one of said input feet being mounted to pivot about a first axis whose location is fixed relative to said structure; and said compression member being constrained to move in a direction parallel to the bisector of the angle defined between said input legs.

2. The apparatus of claim 1 wherein one of said output feet is constrained to pivot about a second axis whose location is fixed relative to said compression member, said first and second axes being parallel.

3. The apparatus of claim 1 wherein one of said output feet is constrained to pivot about a second axis whose location is fixed relative to said compression member, said first and second axes being parallel and lying in a common plane parallel to said bisector.

4. The apparatus of claim 1 wherein said apparatus has a control system connected to operate said drive and said compression member in response to a signal from said sensor.

5. An apparatus for compacting refuse, comprising:

a compression member for compressing refuse collected in a receptacle;

a drive connected to move said compression member;

a sensor for gauging the level of refuse in the receptacle;

a structure to which said drive is mounted, said structure including a housing enclosing said drive, said compression member and said sensor, said housing defining an enclosure having a space for accommodating the receptacle and having a door by which refuse can be deposited in the receptacle;

said drive and said compression member being operable to compact refuse in the receptacle;

said drive including a scissors mechanism having a pair of input feet mounted to said structure and a pair of output feet mounted to said compression member;

one of said input feet being constrained to pivot about a first axis whose location is fixed relative to said structure;

the other of said input feet being constrained to follow a first linear path lying on a radius from said first axis;

one of said output feet being constrained to pivot about a second axis, whose location is fixed relative to said compression member;

the other of said output feet being constrained to follow a second linear path lying on a radius from said second axis;

said first and second axes being parallel and lying in a common plane;

said first and second paths being parallel;

the others of said input and output feet both lying to the same side of said plane; and said paths being perpendicular to said plane.

6. The apparatus of claim 5 wherein said drive comprises a pair of said scissors mechanisms mounted in parallel.

7. The apparatus of claim 6 wherein:

the others of said output feet of said pair of parallel scissors mechanisms each has one of a pair of gears mounted thereto;

said gears are mounted to a common shaft parallel to said second axis; and each of said gears is constrained to mesh with a linear rack mounted to said compression member.

8. The apparatus of claim 5 wherein:

said drive further includes a motor, a screw driven by said motor, and a yoke engaged to be moved by said screw;

said yoke has a screw follower mounted to ride on said screw, a drag member connected to move the other of said input feet and a resilient member mounted to transmit motion between said screw follower and said drag member.

* * * * *

UNITED STATES PATENT AND TRADEMARK OFFICE

CERTIFICATE OF CORRECTION

PATENT NO. : 6,367,377 B1 
DATED : April 9, 2002
INVENTOR(S) : James Ernest Gawley, Charlotte Mary-Anne May and Glenn Emile Rochon It is certified that error appears in the above-identified patent and that said Letters Patent is hereby corrected as shown below:

Column 6,
Line 58, after "thereof" insert -- , --.

Column 7,
Line 45, "Shafts" should read -- shafts --.

Column 8,
Line 29, "pat" should read -- path --.
Line 34, delete "bear" and insert therefor -- linear --.

Column 9,
Line 9, delete "1%" and insert therefor -- 196 --.
Line 44, "tun" should read -- turn --.
Line 54, delete "achievet is" and insert therefor -- achieve this --.
Line 56, "filly" should read -- fully --.

Column 10,
Lines 46, 48 and 51, "fill" should read -- full --.

Column 13,
Line 30, delete "We" and insert therefor -- What --.

Signed and Sealed this

Tenth Day of September, 2002

*Attest:*

*Attesting Officer*

JAMES E. ROGAN
*Director of the United States Patent and Trademark Office*